United States Patent [19]

Creagan et al.

[11] Patent Number: 4,724,047

[45] Date of Patent: Feb. 9, 1988

[54] HORIZONTAL TWIN WIRE MACHINE

[75] Inventors: Richard W. Creagan, Kirkland; Alan J. Nicol, St. Lazare, both of Canada

[73] Assignee: The Black Clawson Company, Middletown, Ohio

[21] Appl. No.: 39,500

[22] Filed: Apr. 17, 1987

[51] Int. Cl.[4] ..... D21F 1/36; D21F 1/00

[52] U.S. Cl. ..... 162/300; 162/301; 162/352; 162/DIG. 7

[58] Field of Search ..... 162/300, 301, 348, 303, 162/352, DIG. 7

[56] References Cited

U.S. PATENT DOCUMENTS

| | | | |
|---|---|---|---|
| 3,994,774 | 11/1976 | Halme et al. | 162/301 |
| 4,146,424 | 3/1979 | Justis | 162/301 |
| 4,447,295 | 5/1984 | Bubik et al. | 162/300 |
| 4,557,802 | 12/1985 | Waris | 162/301 |
| 4,623,429 | 11/1986 | Tissari | 162/301 |

OTHER PUBLICATIONS

Davies, Rebuilding Existing Paper Machines to Gain Quality and Quantity, Pulp & Paper Canada 1985 pp. 55–57.

*Primary Examiner*—S. Leon Bashore
*Assistant Examiner*—K. M. Hastings
*Attorney, Agent, or Firm*—Biebel, French & Nauman

[57] ABSTRACT

All of the essential operating parts for converting an existing Fourdrinier paper machine into a top former are carried by a supplemental frame assembly which can be mounted on the main Fourdrinier frame with no modification of the latter except the addition of a pair of pivotal mountings and a pair of adjusting jacks for the supplemental frame assembly. The primary operating parts of the top wire assembly are a hollow foraminous roll and a top deflector which cooperate to collect and deliver liquid extruded through the top wire into a receptacle which is carried by the supplemental frame assembly. Provision is also made for operating the resulting top former in roll formation mode, blade formation mode, or a combination roll and blade formation mode.

9 Claims, 4 Drawing Figures

HORIZONTAL TWIN WIRE MACHINE

BACKGROUND OF THE INVENTION

This invention relates generally to paper making machines of the Fourdrinier type wherein the paper is formed on an essentially horizontal run of forming wire traveling from the breast roll to the couch roll.

The invention is more specifically directed to a recent trend in Fourdrinier machines wherein a second wire is mounted on top of the primary wire downstream from the breast roll so that liquid is expressed from the stock on the primary wire through both wires. This type of combined machine is now commonly referred to as a "top former" machine, and as background for the description of the present invention, reference is made to the top former machine shown in Creagan et al U.S. Pat. No. 4,532,008, issued July 30, 1985 to the assignee of the present invention.

SUMMARY OF THE INVENTION

The present invention has as a primary object the provision of a top former machine similar to the machine disclosed in the Creagan patent, and capable of producing similarly superior paper free of two sidedness, but which will be simpler and even less expensive than the machine shown in the Creagan patent, and which will require even less modification of existing Fourdrinier machine structure.

The invention is particularly concerned with problems that have existed in top former machines with respect to the collection and removal of water expressed through the top wire, which necessarily must first be collected within the loop of the top wire. It is also particularly concerned with the provision of a top wire assembly of such construction and mode of operation as to minimize the cost of its production and installation on an existing Fourdrinier machine.

More specifically, the top former of the present invention comprises an auxiliary frame assembly which can be mounted on top of the main frame of an existing paper machine by a pair of pivot brackets, and can thereafter be raised and lowered with respect to the main frame and primary wire by a simple jack arrangement at the front and back of the main frame. In addition to the rolls for supporting and driving the secondary wire, this supplemental frame assembly also supports a large hollow roll having a foraminous surface which in most instances will be so vertically positioned as to guide the top wire into converging relation with the primary wire.

In addition to this hollow roll, the supplemental frame assembly carries a vertically adjustable wire deflector spaced downstream from the vertical center line of the hollow roll so that it can skim liquid from the upper surface of the top wire. This top deflector acts in effect as the lower edge of a cylindrically curved shield which extends upwardly in essentially concentric relation with the hollow roll to define therewith a partial annular space for receiving liquid skimmed from the wires by the top deflector. This shield extends beyond the vertical center line of the hollow roll, so that liquid in the space between it and the roll is carried up and over the top of the hollow roll to a position from which it is discharged by centrifugal force into a save-all receptacle mounted in the supplemental frame assembly just upstream from the hollow roll.

A special feature of the former of the invention is that by simple mechanical adjustments, its mode of operation can be varied from blade formation to dandy roll formation or to a combination of both such modes.

Other features and advantages of structure and mode of operation of the invention will be pointed out in connection with the detailed description of the preferred embodiment which follows below.

DESCRIPTION OF THE PREFERRED EMBODIMENT

Figure 1:
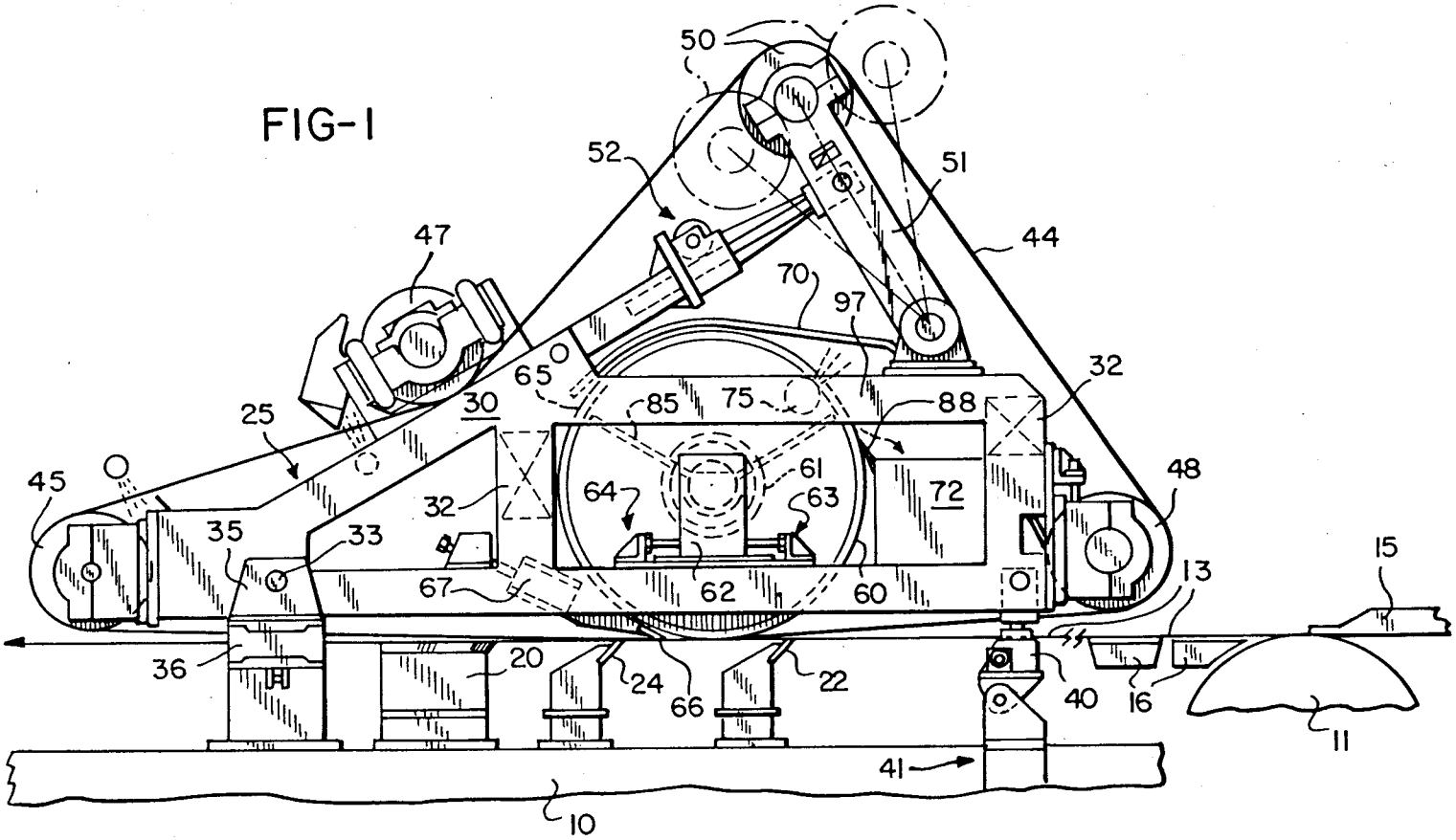
FIG. 1 is a fragmentary side elevation view showing a top former machine in accordance with the invention including an existing Fourdrinier machine.

FIG. 1 shows fragmentarily some of the basic elements of a conventional Fourdrinier paper machine, wherein the main frame includes side beams 10 on which are mounted the breast roll 11, the couch roll (not shown) and the other rolls for supporting the primary forming wire 13. The frame may be of any conventional construction and also supports a headbox 15 which delivers a flow of stock at the breast roll 11 onto the upstream end of the horizontal run of wire 13, which may travel first over a series of foil boxes 16, one being shown, and then over one or more suction boxes 20 to the couch roll. There is a space between the last foil box 16 and the first suction box 20, and in this space are mounted two wire-supporting deflectors 22 and 24 of blade-like construction.

The supplemental frame assembly for supporting the top wire is indicated generally as 25, and it comprises a pair of generally trapezoidal side frames 30 connected together by any suitable arrangement of cross beams, as indicated at 32. The frame assembly 25 is pivotally mounted at its downstream end on each of the main frame side beams 10, as by means of a pivot pin 33 mounted in a pivot block 35 which is in turn mounted on the front beam 10 by a block 36 that is removable for wire-changing purposes. This pivotal mounting is duplicated at the back of the machine.

At its upstream end, the supplemental frame assembly 25 is supported on the main frame 10 by a pair of jack assemblies 40, only the one at the front of the machine being shown, each of which has a pivotal mounting 41 on the adjacent side beam 10 of the main Fourdrinier machine frame. These jack assemblies provide for raising and lowering the entire top former assembly about the pivot pins 32 for purposes explained hereinafter.

The top wire 44 is supported or guided on the frame assembly 25 by four rolls, the roll 45 at the downstream end of the frame assembly being a drive roll shown as driven through a belt or chain by a motor 46 mounted at the back of the frame assembly 25. The roll 47 is a conventional wire guide roll, which the wire 44 may run over or under as shown. The roll 48 at the upstream end of frame 25 is an idler roll, and the roll 50 is a wire tensioning roll carried by arms 51 pivoted at 52 to frame 25. Each arm 51 is provided with a jack assembly 52 pivotally mounted between it and the supplemental frame 25 for causing roll 50 to swing back and forth as necessary to tension the top wire 44.

A relatively large hollow roll 60 is rotatably mounted inside the frame assembly 30 by bearings 61 on a stationary shaft 62, and the supports 63 for shaft 62 are mounted on each of the side frames 30 for accurately controlled adjusting movement lengthwise of the machine, as by the adjustment mechanism indicated at 64. The roll 60 is provided with a foraminous peripheral shell, such as a conventional wire covering of the type used on dandy rolls and the like, and by way of example, satisfactory test results have been obtained with the roll 60 having an outer diameter of 42 inches. The location of roll 60 in frame 25 is such that its vertical centerline is between, but not necessarily equidistant, the lower or bottom deflectors 22 and 24.

Figure 2:
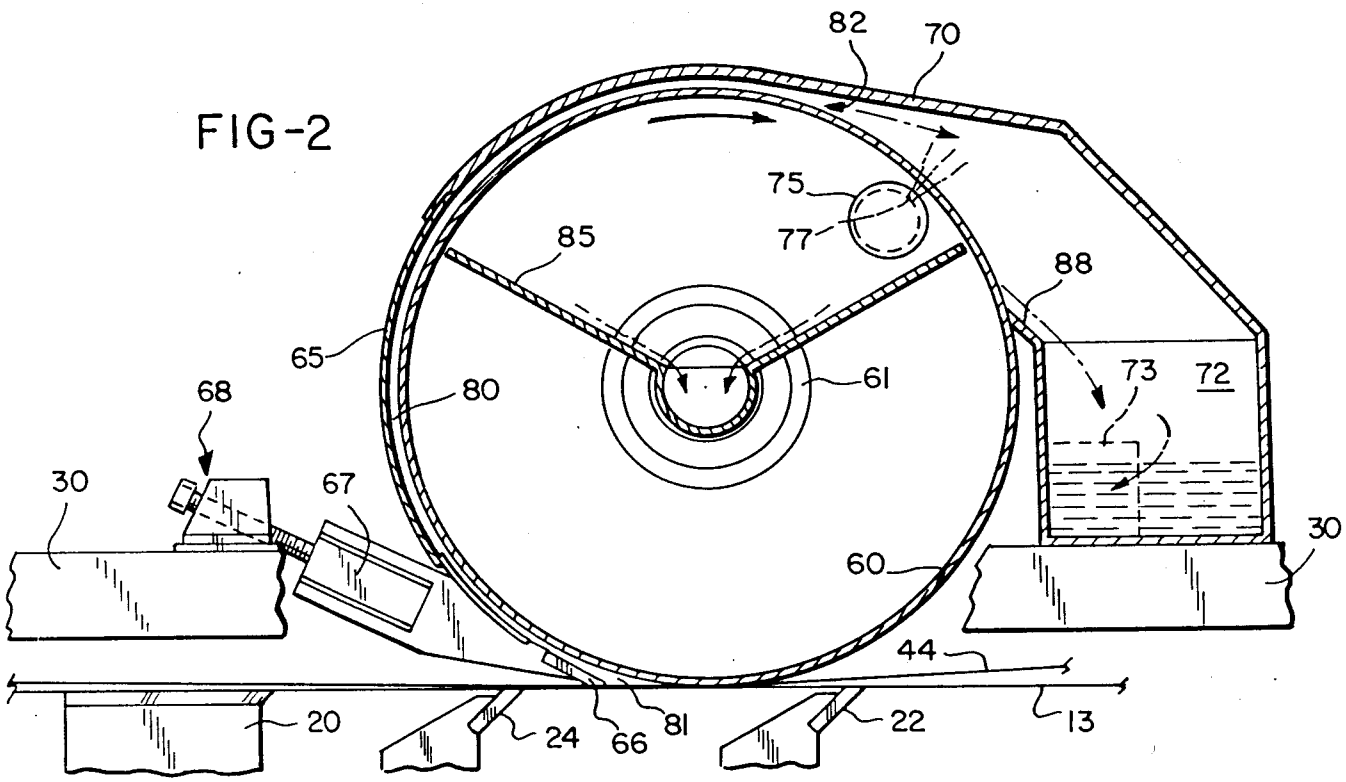
FIG. 2 is an enlarged view of a portion of FIG. 1.

Also mounted inside the frame assembly 30 is a cylindrically curved shield member 65 which extends upwardly for approximately 180° from a position on the upstream side of the vertical centerline of roll 50, shown as near 7 o'clock as viewed in FIG. 2, to a position at or on the opposite side of the vertical centerline of roll 65. A top wire deflector 66 forms the lowermost edge of the shield 65, and it is mounted on shield 65 in position to engage the wire 44 between the vertical centerline of roll 60 and the downstream bottom deflector 24.

Provision is made for accurately vertical adjustment of deflector to vary the extent to which extends below the horizontal plane defined by the bottom deflectors 22 and 24. For example, such adjusting means may comprise a series of slidable mountings 67 extending across the width of shield 65 and each provided with an adjusting jack or screw mechanism 68.

At its upper end, the cylindrically curved shield 65 is continued by an essentially flat top shield 70 which extends tangentially downwardly therefrom at a small angle to the horizontal and then at a greater angle into overlying relation with a save-all pan 72 mounted in the frame assembly 30 just upstream from the roll 60. The shield 70 is joined to the upstream wall of the save-all pan 72. White water collected in the pan 72 is discharged through a suitable outlet at the back of the machine, as indicated at 73. In addition, a pressure air pipe 75 may be mounted inside the roll 60 and provided with an outwardly facing outlet slot 77 for discharge of air through the surface of roll 60 to blow liquid therefrom towards the shield 70 and thus into pan 72.

For preferred operating conditions, the shield 65 should be cylindrically curved about a radius slightly larger than the outer radius of the hollow roll 60, e.g. a difference of the order of one quarter inch. Also, the roll 60 should be positioned in accurately concentric relation with the shield 65, by means of the adjustment mechanism 64 as noted above. This arrangement will provide a partial annular channel 80 between the opposed surfaces of roll 60 and shield 65, which will run from an entry throat 81 between the channel of the roll and the top deflector 66 to its enlarged outlet end between the upper surface of roll 60 and the flat shield 70.

An additional liquid collecting pan 85, of generally funnel shape in vertical section lengthwise of the machine direction, is mounted inside the hollow roll 60. This pan 85 is shown as mounted on the stationary shaft 62 with its sides extending toward 10 o'clock and 2 o'clock positions respectively, to collect whatever liquid may fall from the upper portion of the surface of roll 60.

An opening 86 is provided in the top portion of shaft 62 for receiving such liquid for transmission through the hollow interior of shaft 62 to an outlet at the back of the machine, not shown, leading to the usual white water pit. In addition, a doctor 88 of any suitable material is mounted at the top of the downstream wall of the save-all pan 72 to skim off whatever liquid might adhere to the outer surface of roll 60 and deliver that liquid to the interior of pan 72.

As pointed out hereinabove, the former of the invention is capable of operation to effect roll formation of the sheet, blade formation of the sheet, or a combination of both roll and blade formation. It should be noted, however, that for all operating conditions wherein the wire 44 is in contrast with the hollow roll 60, this roll should be driven at the same surface speed as both of the wires 13 and 44. Roll 60 may be provided with its own drive, but it is advantageous if it is driven by the top wire motor 46, through a belt or chain 90 to a relatively large sheave or gear 91 fixed on the back end spider or hub of the roll 60.

For roll formation, the frame 25 will be adjusted to such vertical position that the roll 60 will guide a run of the top wire 44 downwardly from the upstream wire guide roll 48 into converging relation with the run of primary wire 13 between the bottom wire deflectors 22 and 24. This adjustment should be such that the roll 60 will press the converged wire runs at least slightly below the horizontal level established by the deflectors 22 and 24, the amount of this deflection of the wire runs being based on overall operating conditions and the sheet being produced, as determined by the skill of the operator.

The result of these conditions will be that as the two wire runs converge to the point where they are being forced toward each other by the opposing forces of wire tension and the roll 60, there will be rapid expression of white water through the primary wire to the white water pit, and also through the top wire into the interior of roll 60. In this way, the proper conditions for roll formation will be created in the wedge zone between the two wire runs which is immediately upstream from the vertical center line of roll 60.

As the wires then travel to the downstream bottom deflector 24, they will be forced together by their relative tensions until they travel over deflector 24, with continued expression of liquid through both wires. After leaving deflector 24, the wire-sheet-wire sandwich travels to the suction box 20, which acts to hold the sheet on the primary wire 13 while the top wire 44 separates therefrom in order to travel upwardly to its drive roll 45.

When the top former is operating in a strictly roll formation mode, the top deflector 66 should be set into skimming relation with the upper surface of the top wire 44 so that it will continuously skim from the wire the liquid that has been extruded upwardly therethrough from between the two wires. The extruded liquid will initially be carried by its own momentum through the entry throat 81 into the channel 80 between roll 60 and shield 65, and its momentum and the pumping action of roll 60 will cause this liquid to be carried through channel 80 to its upper end 82 through which it is discharged by centrifugal force into the save-all pan 72.

As already noted, in roll formation, some liquid will also be forced through the foraminous surface of roll 60 into its interior, and it will similarly be held by centrifugal force, and by the liquid already present in the channel 80, in the radially outer portion of the roll until it is discharged by centrifugal force toward the flat shield 70 after it has passed the 12 o'clock position of roll 60. This discharge of liquid through the surface of roll 60 can also be aided by the pressure air pipe 75 as noted above.

Some of the liquid inside roll 60 may also fall therefrom into the pan 85, and the amount of such inwardly discharged liquid will depend directly upon the rotational speed of roll 60 and the resultant centrifugal force effective on the liquid inside that roll. For example, with the roll 60 having an outer diameter of 42 inches, at wire speeds in the range of 300 to 500 feet per minute, the rotational speed of roll 60 will range from as low as 26 rpm to approximately 44 rpm, and the centrifugal force will be so low that at least the major part of the liquid entering roll 60 will fall into the pan 85. As the wire speed increases, however, the resulting increase in centrifugal force will cause most of the liquid to be discharged outwardly of roll 60, into the channel 80 and thence to the save-all pan 72.

In order to operate the former in a combined blade and roll formation mode, the assembly 25 is adjusted downwardly to a position wherein the roll 60 is slightly above the horizontal plane defined by the bottom deflectors 22 and 24. The top deflector 65 is then adjusted downwardly to a position wherein its lower edge is at or below the plane established by deflectors 22 and 24.

Under these conditions, the roll formation which takes place in the wedge zone upstream from roll 60 will be supplemented by blade formation as the two wire runs travel downwardly to and around top deflector 66 and then upwardly therefrom to and around the bottom deflector 24. Operation in this combined mode will increase the tension pressure on the two wire runs as they travel from the roll 60 to the deflector 24, with resulting increase in the volume of liquid expressed through the two wires, but this liquid will still be handled in the same way as described above in connection with roll formation.

In order to operate the former in a blade formation mode, the supplemental frame 25 is raised to a level such that the roll 60 is spaced above the horizontal plane established by the deflectors 22 and 24. The top deflector 66 is then adjusted downwardly so that its working lower edge is spaced sufficiently below the surface of roll 60 that it will extend through the horizontal plane defined by the bottom deflector blades 22 and 24. This adjustment may be such that the top wire 44 will wrap a small portion of roll 60 in traveling to the deflector 66, or the wire may have no contact with the roll 60.

Under either of these conditions, formation will take place as the two wire runs converge toward the deflector 66, and travel around the edge of that deflector to and over the downstream lower deflector 24. The result of this arrangement will be true blade formation, under conditions closely similar to those described in the above Creagan patent, with the two deflectors 66 and 24 operating in conjunction with wire tension as the major liquid-removing elements in the forming zone. As in the other examples, liquid expressed through the primary wire will fall into the white water pit, and liquid expressed through the top wire will be carried through the partial annular space 80 to the save-all pan 72.

An important operating feature of the former of the invention is provided by the combination of the pivotal mounting of the frame assembly 25 on the main frame and the associated adjusting jacks 40. More specifically, in all operating modes, this combination makes it very simple to adjust the pressure between the wires during and after their convergence as desired to suit different grades of paper and wire speeds. This practical advantage is further contributed to by the provision for effecting vertical adjustment of the top deflector 66 with respect to the frame assembly 25.

It is also important to the versatility of operation of the top former of the invention if the bottom deflectors 22 and 24 are mounted for adjustment lengthwise of the machine direction over a range which will enable them to be as close to each other as 12 inches or as far from each other as 24 inches. For example, the bottom deflectors 22 and 24 may be mounted, as shown, on the frame beams 10 by bolts in a series of selectably usable holes in the beams 10. In general, the bottom deflectors are used in closely spaced relation for lightweight sheet, and are moved further apart for heavier sheet.

In addition to its versatility in operation, the top former of the invention has a variety of practical advantages which derive from its structure. More specifically, the supplemental frame assembly 25 is of simple but rugged construction, and what is especially important is that minimal modification of an existing Fourdrinier machine is required in order to equip it with the top former assembly of the invention. More specifically, modification of the existing machine is limited to equipping it with the two lower deflectors 22–24 and the mountings for the pivot blocks 35 and jack assemblies 40.

Figure 3:
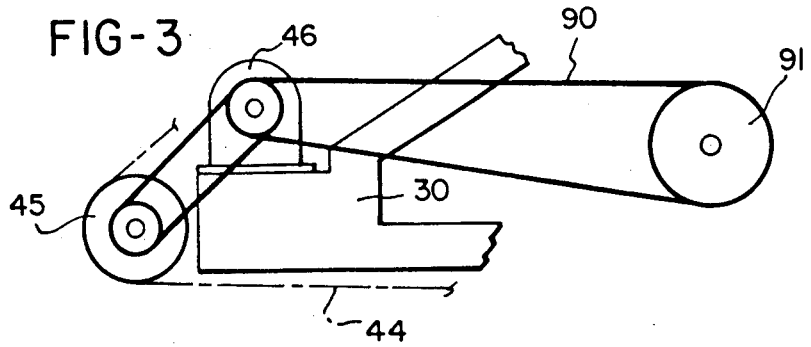
FIG. 3 is a fragmentary view in side elevation indicating the drive arrangement for the top former of FIG. 1.
Figure 4:
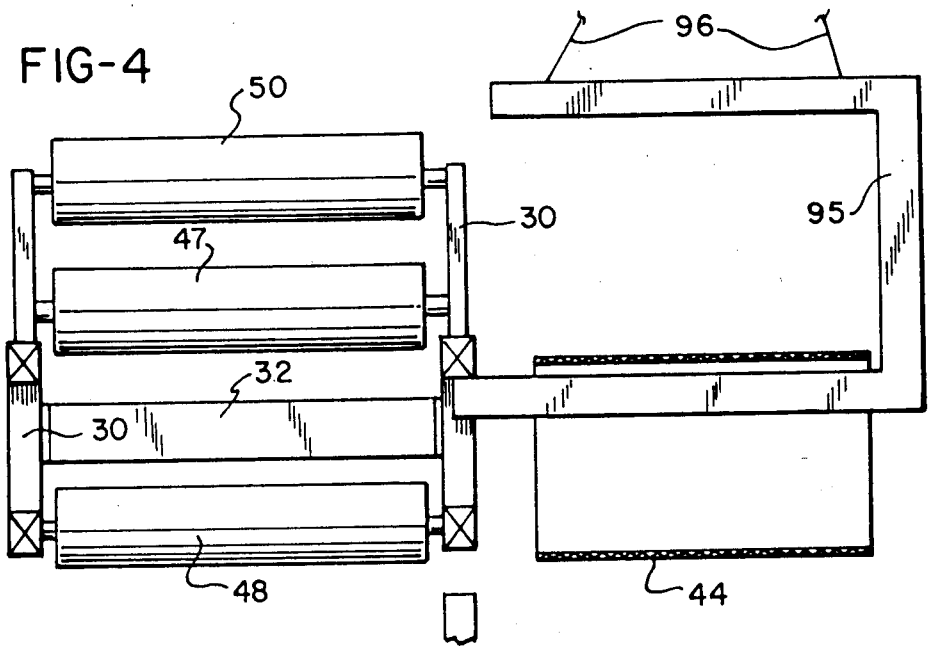
FIG. 4 is a somewhat diagrammatic view looking from left to right in FIG. 1 and illustrating the operation of changing the top wire in the former of FIG. 1.

Another practical advantage which derives from the structure of the former of the invention is the ease with which the wire 44 can be changed. As illustrated in FIG. 3, a new wire 44 may be strung on the lower arm of a generally C-shaped hook 95 suspended from the conventional paper mill crane in the aisle adjacent the machine, as indicated by the cables 96.

In order to string this new wire, it is necessary merely to insert the free end of the lower arm of hook 95 under the upper front beam 97 of the frame 25, and to lift the front side of the frame 25 slightly while removing the block 36 and disconnecting the front jack assembly 40, with the frame assembly 25 still connected to the main Fourdrinier machine frame at the back of the machine. Then with the wire tensioning roll 50 retracted, the new wire can be slipped into position, after which the block 36 is replaced and the hook 95 is removed, and the front jack 40 is reconnected. If the wire 44 runs under the guide roll 48, the guide roll assembly must be temporarily removed, but this is not necessary if the wire runs over the guide roll.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In apparatus for forming paper, including a main frame, means mounted thereon for supporting a generally horizontal run of a primary endless forming wire, and means for delivering a flow of paper making stock to one end of said wire run for drainage therethrough to form a paper sheet thereon while traveling thereon toward the other end of said run, the combination of (a) a supplemental frame assembly mounted on said main frame and supporting a top endless forming wire above said primary wire to define a two-wire run, (b) a roll mounted for rotation in said frame assembly with the axis thereof normal to the direction of travel of said primary wire, (c) said roll being substantially hollow and having a foraminous surface, (d) means for driving said top wire and said roll at linear speeds matching the speed of said primary wire, (e) a pair of wire deflectors positioned below and in supporting relation with said primary wire run on opposite sides of the vertical center line of said roll along said two-wire run, (f) a top wire deflector mounted in said frame assembly at a position spaced between the vertical center line of said roll and the downstream one of said pair of wire deflectors, (g) selective adjusting means connected to said roll and said top wire deflector for locating either said roll or said top wire deflector in position to guide a run of said top wire into converging relation with said primary wire run between said pair of deflectors, (h) a generally cylindrically curved shield mounted in said frame assembly in upwardly extending relation from said top wire deflector and enclosing relation with said roll to a position on the downstream side of the vertical center line of said roll, (i) the relative dimensions and positioning of said shield and said roll establishing a partial annular channel therebetween having the lower end thereof positioned to receive liquid directed upwardly from the inner surface of said top wire by said top wire deflector whereby such liquid is guided by said shield around the outer surface of said roll and discharged centrifugally from said channel in the upstream direction, and (j) means carried by said auxiliary frame and defining a receptacle on the upstream side of said roll for receiving liquid discharged from the upper end of said partial annular space.

2. Apparatus as defined in claim 1 wherein said selective adjusting means comprises (a) means for adjusting said frame assembly vertically with respect to said main frame to establish the vertical position of said roll with respect to said primary wire run, and (b) means for adjusting said top wire deflector vertically on said frame assembly to establish the vertical position of said top deflector with respect to said top wire run.

3. Apparatus as defined in claim 1 wherein the inner radius of said shield is greater than the outer radius of said roll and has the center of curvature thereof located on the horizontal center line of said roll.

4. Apparatus as defined in claim 3 wherein the centers of curvature of the inner surface of said shield and the outer surface of said roll coincide.

5. Apparatus as defined in claim 1 further comprising (a) suction box means supporting said primary wire at a position spaced downstream from said pair of deflectors, and (b) means on said supplemental frame assembly for guiding said top wire run upwardly from said suction box means.

6. Apparatus as defined in claim 1 further comprising (a) means forming a horizontal pivotal connection between said supplemental frame assembly and said main frame, and (b) means for causing controlled movement of said supplemental frame assembly about said pivotal connection to effect vertical adjustment of said roll with respect to said primary wire run.

7. Apparatus as defined in claim 1 further comprising (a) pan means within said hollow roll defining a receptacle for receiving liquid falling from the upper surface portion of said roll within said roll, and (b) means for converging liquid from said pan means to a location outside of said roll.

8. Apparatus as defined in claim 1 wherein said selective adjusting means comprises (a) means forming a horizontal pivotal connection between said supplemental frame assembly and said main frame, (b) means for causing controlled movement of said supplemental frame assembly about said pivotal connection to effect vertical adjustment of said roll with respect to said primary wire wire, and (c) means for adjusting said top wire deflector vertically on said frame assembly to establish the vertical position of said top deflector with respect to said top wire run.

9. Apparatus as defined in claim 1 further comprising means mounting said pair of deflectors for adjustment with respect to each other lengthwise of said main frame.

* * * * *